US006705466B2

(12) United States Patent
Bartholomew et al.

(10) Patent No.: US 6,705,466 B2
(45) Date of Patent: Mar. 16, 2004

(54) PACKAGING STRUCTURE WITH SLIDING RETAINERS FOR SHEETS OF MATERIAL

(75) Inventors: David M. Bartholomew, Greensburg, PA (US); Brandon J. Craig, Greensburg, PA (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 10/058,449

(22) Filed: Jan. 28, 2002

(65) Prior Publication Data

US 2003/0141213 A1 Jul. 31, 2003

(51) Int. Cl.[7] ..... B65D 85/48; B65D 19/00; B65D 73/00; B65D 21/00

(52) U.S. Cl. ..... 206/454; 206/451; 206/453; 206/386; 206/480; 206/511; 206/825

(58) Field of Search ..... 206/454, 451, 206/449, 556, 448, 511, 453, 321, 325, 587, 386, 599, 600, 483, 711, 708, 480, 560, 825; 108/53.5; 211/41.14, 41.18, 41.1, 162, 207, 175, 193, 190

(56) References Cited

U.S. PATENT DOCUMENTS 2,110,299 A * 3/1938 Hinkle ..... 206/560
3,193,093 A * 7/1965 Hansen ..... 206/451
4,934,538 A * 6/1990 Beyer ..... 211/194
5,145,073 A 9/1992 Kitagawa et al.
5,148,924 A * 9/1992 Mason et al. ..... 206/454
5,803,257 A 9/1998 Bartholomew
5,813,536 A 9/1998 Bartholomew
6,098,804 A 8/2000 Bartholomew
6,102,206 A 8/2000 Pride

* cited by examiner

*Primary Examiner*—Mickey Yu
*Assistant Examiner*—Greg Pickett
(74) *Attorney, Agent, or Firm*—George E. Haas; Quarles & Brady LLP

(57) ABSTRACT

A rack for shipping and storing a plurality of glass panels includes a frame which holds a bottom support and a rear support in planes that intersect at substantially a right angle. The bottom and rear supports have notches to receive edges of the panels. The rear support has a plurality of channels with a separate retainer slidably received in each channel for engaging an upper edge of a panel placed in the rack. A spring loaded mechanism maintains the retainers in engagement with the respective panel, thereby holding the panels in the rack.

21 Claims, 3 Drawing Sheets

FIG. 3
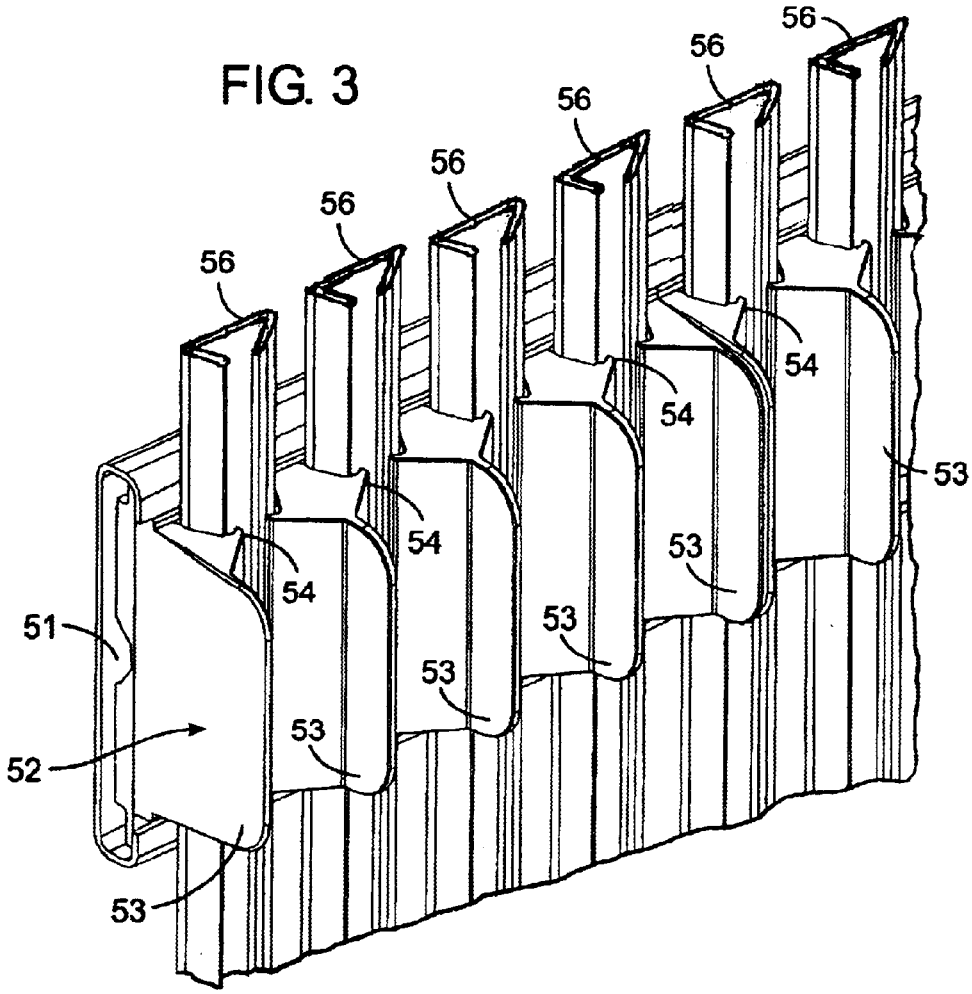
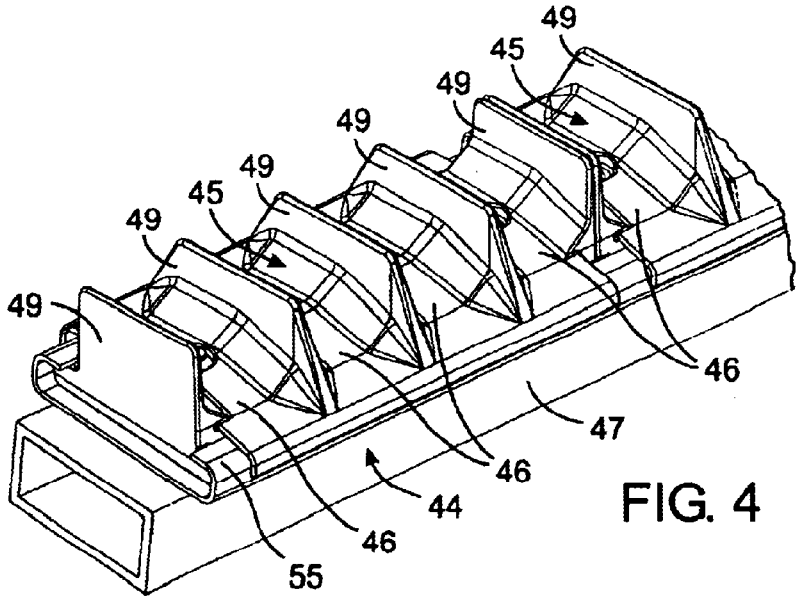
FIG. 4

PACKAGING STRUCTURE WITH SLIDING RETAINERS FOR SHEETS OF MATERIAL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to containers for storing and shipping panels of material, such as panes of glass.

2. Description of the Related Art

Flat panels of glass are commonly shipped in a bundle with a powder between abutting panels. The bundle often is secured in a steel rack by metal or plastic bands which encircle the bundle. The racks often are stacked one upon another in a warehouse with the lower racks supporting the weight of the racks above.

More recently packaging has been devised which employ four corner caps that fit along the intersection of the edges of the bundle of glass panels, as described in U.S. Pat. Nos. 5,813,536 and 6,098,804. Corrugated cardboard or wooden sheets extend vertically between adjacent pairs of the corner caps to prevent the stack from racking. Metal or plastic bands then are placed around the bundle to hold the corner caps in place. Although that corner cap structure was an improvement over the racks used previously, the glass panels carried the weight of bundles stacked above.

The prior packaging structures often required that all the panels have the same size and shape. This presents a problem when a particular customer orders a variety of glass panels, in which case separate packaging structures must be used for each size. Furthermore, a customer may require that the different sized pieces be packaged in the particular sequence that the customer needs them in order to fabricate an assembly of glass panels, such as a large window unit that has glass panes of different sizes.

Certain glass panels have delicate coatings that are easily marred and thus must be packaged without touching other panels.

As a consequence, there is a desire to be able to mix glass panels of different sizes and shapes in a single packaging structure and individually support each panel.

SUMMARY OF THE INVENTION

The present invention provides a protective packaging structure in which to ship and store a bundle of panels, such as glass panes. Each panel has two major surfaces and a plurality of edge surfaces between the two major surfaces.

The packaging structure has a frame to which a bottom support and a rear support are attached in planes that intersect at substantially a right angle. The bottom support and the rear support hold a plurality of panels in parallel planes that are perpendicular to the planes of those supports. The rear support has a major surface with a plurality of channels. A separate retainer is slidably received in each channel of the rear support in order to engage an upper edge of one of the panels placed in the packaging structure. That engagement applies force which holds the panels against the bottom support. A mechanism, such as a spring, maintains each retainer in engagement with the respective panel.

In the preferred version of the present packaging structure, each panel is slid into notches formed in the bottom and rear supports, thereby restraining the panels from moving transversely to the supports. One of the retainers then is brought into engagement with the panel to force the panel against the bottom support and hold the panel in the packaging structure. Preferably, the planes of the bottom support and the rear support are canted with respect to the horizontal and vertical planes, respectively. This canting results in gravity causing the panels to nest into the intersection of those supports.

BRIEF DESCRIPTION OF THE DRAWINGS

FIG. 3 is an enlarged view of part of the rear support of the packaging structure;

FIG. 4 is a cut-away isometric view of a support bar in the packaging structure.

DETAILED DESCRIPTION OF THE INVENTION

Figure 1:
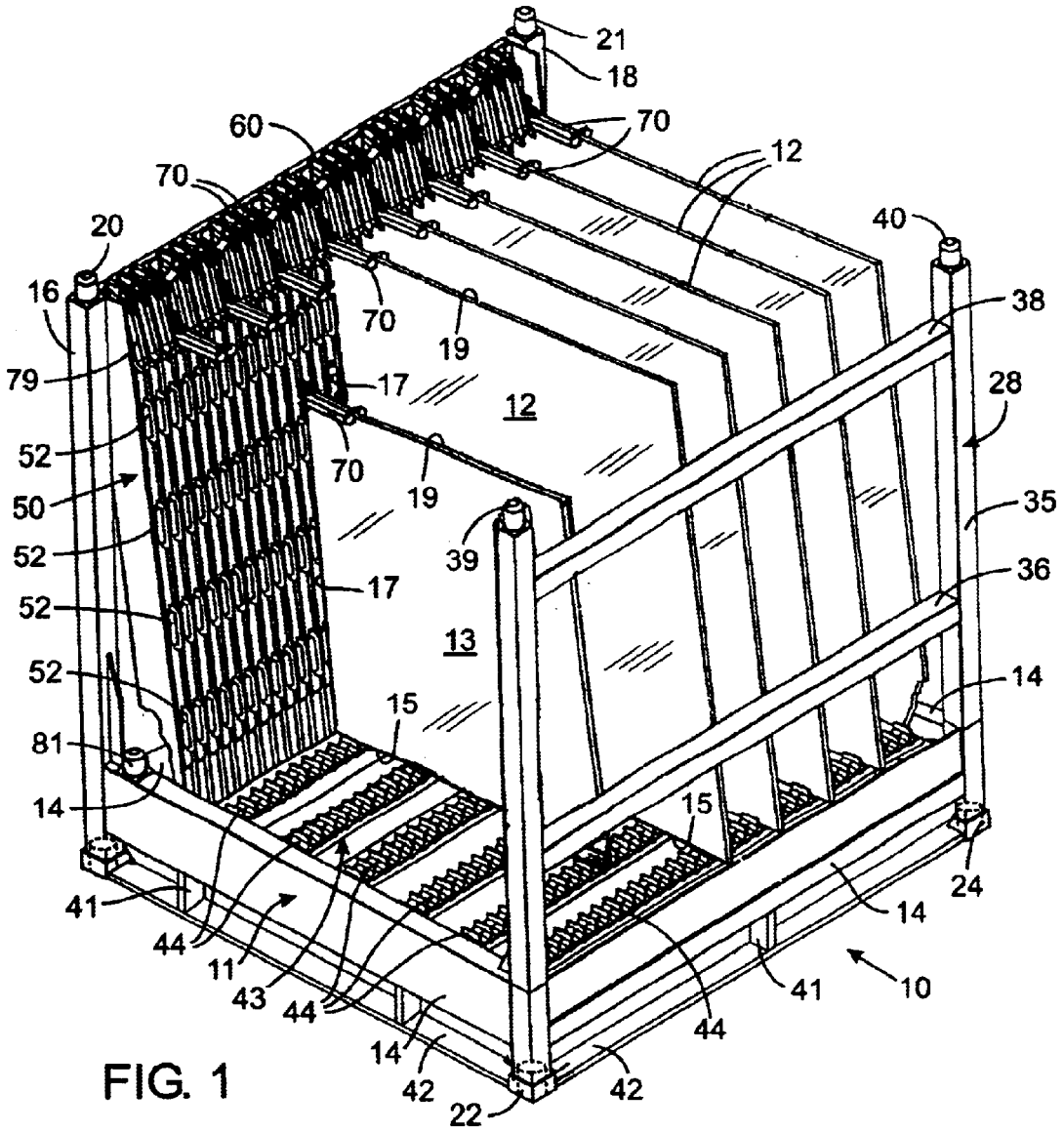
FIG. 1 is an isometric view of several panels of glass contained in a packaging structure according to the present invention.

With reference to FIG. 1, a packaging structure, commonly referred to as a rack 10, holds a plurality of rectangular glass panels 12 and 13 each having two major surfaces with four narrow edges extending between the two major surfaces. The glass panels 12 and 13 are placed on edge, parallel to one another in the rack 10. Although the present invention is being described in the context of a rack for glass panels, one should appreciate that the novel concepts can be used in structures that hold other types of panels.

Figure 2:
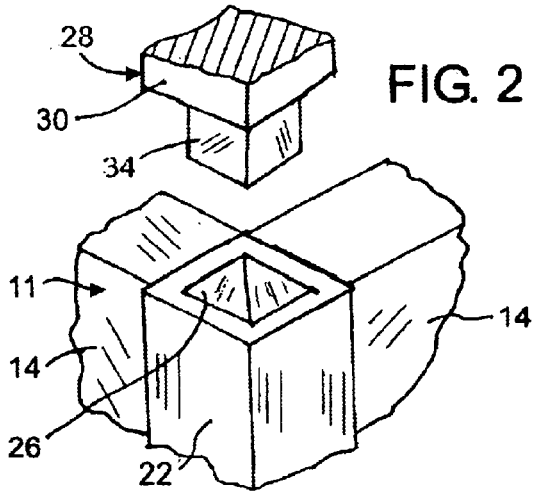
FIG. 2 is a cut-away view of a corner of the packaging structure.

The rack 10 has a rectangular frame 11 formed by four primary rails 14, the ends of which are connected at four corners. A separate vertical post 16 or 18 is located at the rear corners of the frame 11 and extends above and below the frame for the full height of the packaging structure. The two front corners of the frame 11 have short corner members 22 and 24 that are flush with the top surface of the frame 11 and extend downward from the frame. The top of each of these corner members 22 and 24 has a square aperture 26 therein as shown in FIG. 2. Separate bottom rails 42 extends between adjacent pairs of the rear posts 16 and 18 and corner members 22 and 24 beneath the primary rails 14. Vertical supports 41 extend between the primary and bottom rails 14 and 42 creating openings there between through which tines of a forklift can fit to transport the rack filled with glass panels.

Referring to FIGS. 1 and 2, a removable front gate 28 has a pair of vertical posts 30 and 32 which have bottom ends with square tabs 34 that fit into the square apertures 26 in the rack corner members 22 and 24 to mount the gate on the frame 11. The tops of the gate posts 30 and 32 are at the same height as the tops of the posts 16 and 18 at the rear corners of the frame. A pair of horizontal gate rails 36 and 38 extend between and are fixed to the two gate posts 30 and 32.

The top of each post 16, 18, 30, and 32 of the rack has a cylindrical knob 20, 21, 39, and 40, respectively. The bottom ends of posts 16 and 18 and of corner members 22 and 24 are open for receiving the post knobs 20, 21, 39, and 40 of another rack when two racks loaded with glass panels are stacked one on top of the other. The engagement of the knobs and apertures secures the stacked racks together. When the racks are stacked on top of each other, the weight of the upper racks is transferred through the posts 16, 18, 30, and 32 and the glass panels 12 and 13 do not receive that force.

A bottom support 43 is formed by six bars 44 which extend across the interior of the frame 11 to provide support for the bottom edges 15 of the glass panels 12 and 13. These frame support bars 44 lay in a common plane between two opposite primary rails 14 of the frame 11 and are equally spaced along those primary rails. The plane of the bars 44 of the bottom support 43 slopes downward at a six degree angle going from the front of the rack 10 at posts 22 and 24 to the rear at which posts 16 and 18 are located.

The frame support bars 44 are shown in detail in FIG. 4 and comprises a rectangular metal tube 47, that is welded to the opposite primary frame rails 14, and a metal channel 55 with front and rear edges rolled over. A plurality of plastic panels 45 are slid end to end into the channel and a number of machine screws secure the channel and the panels to the metal tube 47. The plastic panels 45 have a series of tabs 49 projecting upward at regular intervals along the length of the channel 55, thereby forming a plurality of notches 46 between adjacent tabs. The tabs 49 and notches 46 are aligned from one support bar 44 to another so that the bottom edge 15 of each glass panel 12 or 13 fits within a linear array of notches 46. The sides of the notches 46 are tapered to center the glass panels between the upstanding tabs 49 and restrain the glass panels 12 and 13 from moving along the frame support bars 44 toward each other.

Referring again to FIG. 1, a rear support 50 extends from the rear of the frame 11 upward and is attached to the upper portions of the two rear posts 16 and 18. The plane of the rear support 50 is tilted backward to be substantially orthogonal to the sloping plane of the bottom support bars 44. As a result of this tilted arrangement, two abutting edges 15 and 17 of the rectangular glass panels 12 and 13 placed in the rack 10 nest against the bottom support bars 44 and the rear support 50 due to gravity. The plane of the rear support 50 does not have to be precisely orthogonal (i.e. exactly 90°) to the plane of the bottom support bars 44 as long as the edges 15 and 17 of the glass panels 12 and 13 are retained by notches in the bottom and rear supports 43 and 50, as will be described.

The rear support 50 is formed by four horizontal support strips 52 that extend between the rear vertical posts 16 and 18 and are spaced apart vertically. A cap 60 is attached across the top of the rear support 50. As illustrated in FIG. 3, each plastic support strip 52 is held within a metal channel 51 that extends horizontally between the rear vertical posts 16 and 18. The rear support strips 52 have a plurality of outwardly projecting walls 53, thereby forming tapered notches 54 there between. The notches 54 in the four rear support strips 52 align in the vertical direction. That alignment enables the rear vertical edges of the glass panels 12 and 13 to wedge into those notches 54 upon being fully inserted into the rack 10. Thus the glass panels are further restrained from moving against each other during shipment.

A separate dove tail track 56 is received and retained in the bottom of each of the notches 54 in the rear support strips 52. Therefore, the plurality of dove tail tracks 56 extend in a generally vertical direction along the full height of the rear support 50. These channels form a series of vertically extending dove tail grooves for the rack 10.

Figure 5:
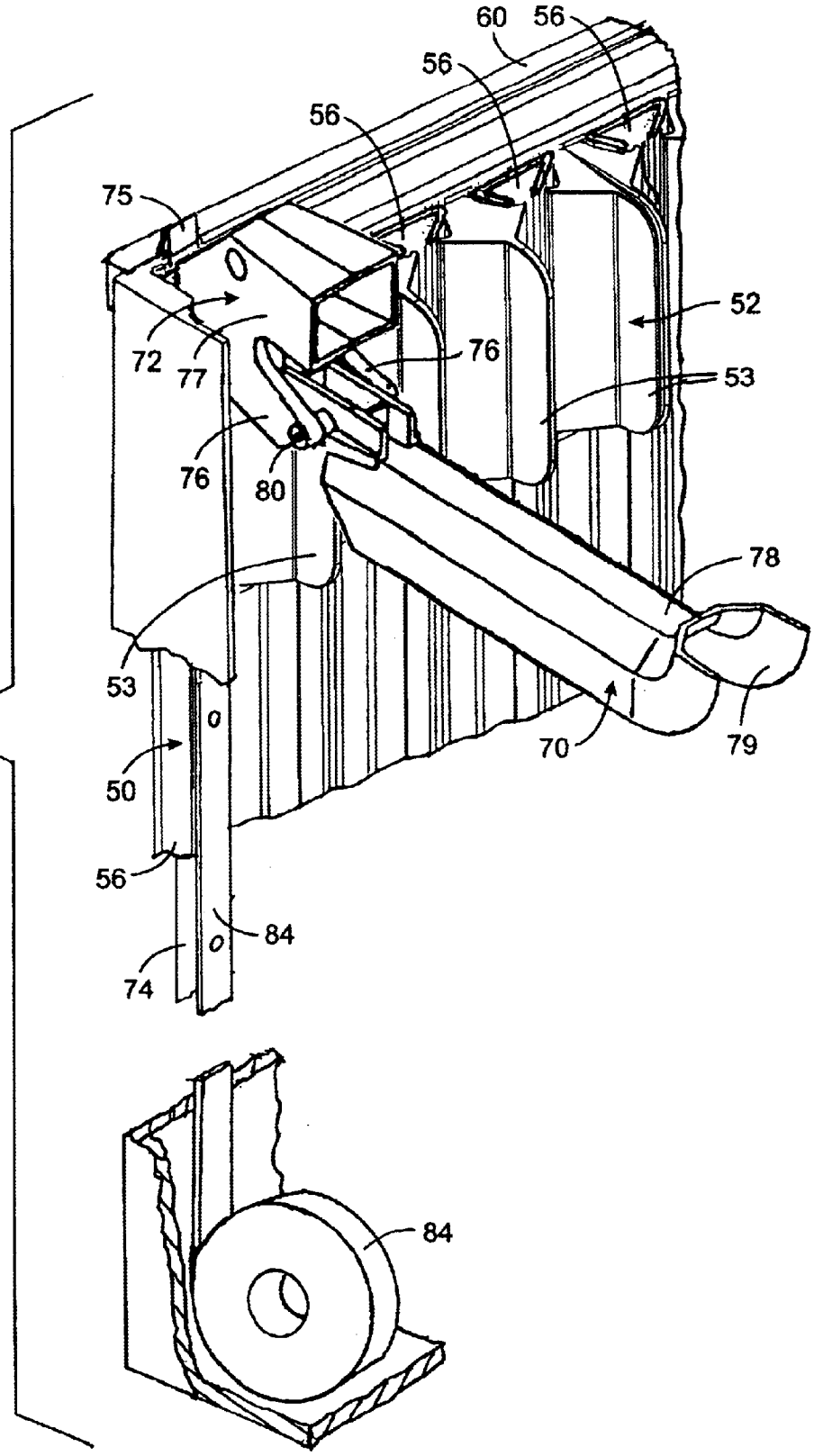
FIG. 5 is a cut-away isometric view of a top section of the rear support.

With reference to FIGS. 1 and 5, a separate panel retainer 70 is slidably received within each dove tail track 56 of the rear support 50. Each retainer 70 has an inverted L-shaped member 72 with a vertical leg 74 that is adapted to fit into and slide along the associated dove tail track 56. Specifically the vertical leg 74 has a dove-tail cross section that mates with the dove-tail groove of the track 56 to confine the retainer 70 in the rear support 50. The top portion of the vertical leg 74 has an enlarged knob 77 for grasping by a user to facilitate raising the panel retainer 70 in the groove formed by the dove tail track 56. A pair of wings 76 extend outward from the top portion of the vertical leg 74. The proximate ends of the wings 76 are closely spaced to pass between the walls 53 of the rear support strips 52. The distal ends of the wings 76 are separated farther and have transverse apertures there through. The panel retainer 70 also has an arm 78 that is pivotally coupled to the wings 76 of L-shaped member 72. Specifically a pin 80 extends through the apertures in the two wings 76 and a corresponding aperture in arm 78.

FIG. 5 illustrates the extended pivotal position of the retainer arm 70 as when it is positioned on top of a glass panel 12 or 13 shown in FIG. 1. The retainer arm 70 is able to pivot downward into a retracted, substantially vertical orientation as illustrated for arm 79 in FIG. 1, when a glass panel is not positioned within the associated portion of the rack. The arms 78 may be biased into the retracted position by a torsion spring (not shown) that wraps around the pivot pin 80. Retraction of the arms 70 and removal of the front gate 28 enables the empty racks to be stacked in a compact nesting arrangement to facilitate transportation. Note that a knob 81 is located on top of a side primary rail 14 near the rear posts 16 and 18 to engage another nesting rack and secure the assembly together.

A constant force spring 84 extends downward from the bottom portion of the L-shaped member 72 within each of the channels on the rear support 50. The spring 84 is held in place at the bottom of the rear support 50. The constant force spring 84 acts like a coiled tape measure and exerts a downward force on the panel retainer 72 which pulls the retainer toward the bottom of the respective channel. The constant force spring 84 exerts a constant downward force of 13 to 23 Newtons. When the retainer 70 is in the fully raised position as shown for the retainer in FIG. 5, a locking tab 75 engages a top edge of the end cap 60 to hold the retainer in that position against the downward force exerted by the spring 84.

Referring again to FIG. 1, when a user desires to load glass panels into the rack 10, the front gate 28 is removed by pulling upward so that the bottom ends of the gate posts 30 and 32 come out of the frame post 22 and 24. This allows large glass panels 12 to be placed into the rack one at a time and into the notches of the bottom support bars 44. The glass panel then is slid toward the rear support 50 and into the notches between the tabs of the support strips 52. The locking tab 75 is disengaged from the upper edge of the cap 60 and slid downward in the respective track 56 of the rear support 50. Note that the tapered notches in the rear support strips 52 do not allow the edge of the glass panel to enter the dove tail grooves in the tracks 56 (see FIG. 3) as that would interfere with sliding the retainer 70.

After the retainer 70 engages the top edge 19 of the glass panel 12, the downward force of the constant force spring 84 is sufficient to open and maintain that engagement and withstand vibration normally encountered during shipment which could otherwise dislodge the glass panel from the bottom support notches 46. That downward force also keeps the glass panels between the tabs of the support strips 52 on the rear support 50. It should be appreciated that the six degree tilt of the bottom support 43 and the rear support 50 in the frame 11 results in the glass panels 12 and 13 tending to nest against the bottom and rear supports due to gravity. This effect also retains the glass panels 12 and 13 within the rack 10.

Glass panels 12 and 13 of different size can be placed within the same rack. As illustrated, panel 13 is significantly smaller than the maximum size which can be accommodated by the rack 10 and nevertheless is firmly held in place by the retainer 70.

The foregoing description was primarily directed to a preferred embodiment of the invention. Although attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

We claim:

1. A packaging structure for a plurality of panels, the packaging structure comprising:

a bottom support having a plurality of members for receiving edges of the plurality of panels;

a rear support having a plurality of tracks extending in a generally vertical direction and having elements for receiving another edge of each of the plurality of panels;

a frame supporting the bottom support and the rear support in positions for holding the plurality of panels in parallel planes that are perpendicular to the planes of the bottom support and the rear support;

a plurality of retainers each slidably received in a different one of the plurality of tracks in the rear support to engage an upper edge of a panel placed in the packaging structure; and a mechanism which maintains each of the plurality of retainers in engagement with the respective panel.

2. The packaging structure as recited in claim 1 wherein the bottom support has a plurality of notches for receiving edges of the plurality of panels.

3. The packaging structure as recited in claim 1 wherein the bottom support comprises a plurality of support bars extending between two opposing sides of the frame.

4. The packaging structure as recited in claim 3 wherein each of the plurality of support bars has a series of tabs defining notches between adjacent tabs in which to receive edges of the plurality of panels.

5. The packaging structure recited in claim 1 wherein the rear support comprises a separate outwardly projecting wall between each pair of adjacent ones of the plurality of tracks.

6. The packaging structure as recited in claim 1 wherein the rear support has a plurality of support strips extending horizontally and spaced apart in an upward direction, each support strip having a plurality of walls thereby defining notches between adjacent walls for receiving edges of the plurality of panels.

7. The packaging structure as recited in claim 1 wherein the rear support comprises a plurality of support strips extending horizontally and spaced apart in an upward direction, each support strip including a plurality of walls which define notches there between, the rear support further comprising a plurality of track members received in the notches of the plurality of support strips.

8. The packaging structure as recited in claim 1 wherein the mechanism comprises a plurality of springs which exert a force on the plurality of retainers.

9. The packaging structure as recited in claim 1 wherein the mechanism comprises a plurality of constant force springs, each attached to one of the plurality of retainers.

10. The packaging structure as recited in claim 1 wherein the frame further comprises a plurality of vertical posts each having a top end with a knob and a bottom end with an aperture for receiving a knob of another packaging structure, thereby enabling two packaging structure to be stacked on one another in an interlocked manner.

11. The packaging structure as recited in claim 1 wherein the frame holds the rear support substantially orthogonal to the bottom support.

12. The packaging structure as recited in claim 1 wherein the bottom support and the rear support are angled in the frame so that gravity causes the panels to nest against the bottom support and the rear support.

13. A packaging structure for a plurality of panels, the packaging structure comprising:

a frame having two opposing sides;

a plurality of support bars extending between the two opposing sides of the frame, each support bar having notches for receiving bottom edges of the plurality of panels;

an upright rear support connected to the frame to engage another edge of each of the plurality of panels, the upright rear support having a plurality of grooves;

a plurality of retainers each slidably received in a different one of the plurality of grooves in the rear support to engage an upper surface of a panel placed in the packaging structure; and a mechanism which maintains each of the plurality of retainers in engagement with the respective panel.

14. The packaging structure as recited in claim 13 wherein plurality of support bars are in a first plane and the rear support extends in a second plane that is substantially orthogonal to the first plane.

15. The packaging structure as recited in claim 13 wherein the rear support has a separate wall located between each occurrence of adjacent grooves to confine movement of the plurality of panels.

16. The packaging structure as recited in claim 13 wherein each of the plurality of support bars has a series of tabs which define notches between.

17. The packaging structure as recited in claim 13 wherein the rear support has a plurality of support strips extending horizontally and spaced apart in an upward direction, each support strip having a plurality of walls defining notches between adjacent walls for receiving edges of plurality of panels.

18. The packaging structure as recited in claim 13 wherein the rear support comprises a plurality of support strips extending horizontally and spaced apart in an upward direction, each support strip including a plurality of walls which define notches there between, the rear support further comprising a plurality of track members forming the grooves and received in the notches of the plurality of support strips.

19. The packaging structure as recited in claim 13 wherein the frame further comprises a plurality of vertical posts each having a top end with a knob and a bottom end with an aperture for receiving a knob of a post of another packaging structure, thereby enabling two packaging structure to be stacked on one another in an interlocked manner.

20. The packaging structure as recited in claim 13 wherein the bottom support and the rear support are angled in the frames wherein the panels tends to nest against the bottom support and the rear support under gravitational force.

21. The packaging structure as recited in claim 13 wherein the mechanism comprises a plurality of springs which exert downward force on the plurality of retainers.

* * * * *